United States Patent [19]

Sellers

[11] Patent Number: 5,069,434

[45] Date of Patent: Dec. 3, 1991

[54] REMOVABLE DUAL BIN ENVELOPE FEED TRAY FOR AN IMAGE REPRODUCTION MACHINE

[75] Inventor: Charles A. Sellers, Houston, Tex.

[73] Assignee: Compaq Computer Corporation, Houston, Tex.

[21] Appl. No.: 648,536

[22] Filed: Jan. 30, 1991

[51] Int. Cl.[5] ..... B65H 3/44

[52] U.S. Cl. ..... 271/2; 271/9; 271/109; 271/126; 271/145

[58] Field of Search ..... 271/2, 9, 109, 126, 271/145, 162, 165

[56] References Cited

U.S. PATENT DOCUMENTS

| | | | |
|---|---|---|---|
| 3,375,003 | 3/1968 | Godlewski | 271/9 |
| 3,391,924 | 7/1968 | Schmidlin et al. | 271/9 |
| 3,934,868 | 1/1976 | Selak | 271/9 |
| 4,109,779 | 8/1978 | Bauer et al. | 400/584 |
| 4,198,041 | 4/1980 | Hughes et al. | 271/9 |
| 4,384,710 | 5/1983 | Gustafson | 271/9 |
| 4,397,542 | 8/1983 | Brodesser . | |
| 4,569,587 | 2/1986 | Miyoshi et al. | 355/72 |
| 4,585,223 | 4/1986 | Tam | 271/121 |
| 4,603,346 | 8/1986 | Miles | 271/2 |
| 4,620,809 | 11/1986 | Runzi | 400/624 |
| 4,625,641 | 12/1986 | Jagosz | 271/2 |
| 4,639,154 | 1/1987 | Myers | 400/584 |
| 4,671,504 | 6/1987 | Lapinski et al. | 271/126 |
| 4,729,683 | 3/1988 | Staniszewski | 400/624 |
| 4,733,310 | 3/1988 | Kapp et al. | 358/300 |
| 4,807,805 | 2/1989 | Rutkowski | 229/69 |
| 4,855,794 | 8/1989 | Suzuki | 271/9 |
| 4,980,704 | 12/1990 | Fulton et al. | 271/9 |

FOREIGN PATENT DOCUMENTS

| | | | |
|---|---|---|---|
| 52425 | 3/1985 | Japan | 271/145 |
| 77040 | 5/1985 | Japan | 271/9 |
| 192636 | 8/1986 | Japan | 271/145 |
| 204237 | 8/1990 | Japan | 271/9 |

*Primary Examiner*—Robert P. Olszewski
*Assistant Examiner*—Steven M. Reiss
*Attorney, Agent, or Firm*—Johnson & Gibbs

[57] ABSTRACT

A dual bin envelope tray is adapted to support, in a side-by-side relationship, two stacks of envelopes which may be of different sizes. The envelope tray is configured to be interchangeable with the conventional paper supply tray of a printing device, such as a printer, copier or the like, and may be inserted directly into the printing device housing opening from which the paper tray is removed. Cooperating driving and driven structures, respectively disposed within the housing and on the envelope tray, function to sequentially feed the envelopes in either stack thereof into the printing device housing for passage through its existing printing and paper exit paths.

23 Claims, 3 Drawing Sheets

REMOVABLE DUAL BIN ENVELOPE FEED TRAY FOR AN IMAGE REPRODUCTION MACHINE

BACKGROUND OF THE INVENTION

1. Field of the Invention

The present invention relates generally to image reproduction machinery, and more particularly relates to envelope feed apparatus for printers, copiers and the like.

2. Description of Related Art

Modern image reproduction machines, such as printers and copiers, are typically provided with one or more paper supply trays, each of which is removably insertable into an associated opening formed in the outer housing of the machine. Each tray is adapted to hold a stack of cut paper sheets—typically of 8½"×11" or 8½"×14" size—for infeed to the internal printing portion of the machine and subsequent discharge from the machine housing into an external paper receiving structure.

The handling of envelopes is conventionally accomplished utilizing a separate feed structure externally built onto the housing, normally on a side thereof opposite from the paper supply tray or trays. These envelope feed structures are adapted to hold a single stack of envelopes and successively deliver the envelopes into the interior of the housing for feed therethrough via a path different than that of the paper entering the housing from the opposite side.

Compared to a single sheet of paper, an envelope is quite thick, having four or five stacked layers of paper at the point where its flap overlaps the central back side of the envelope. Accordingly, far fewer envelopes than cut paper sheets can be placed in a stack of a given height. This large stack height associated with envelopes has heretofore limited the number of envelopes that could be held at one time in their dedicated single stack exterior storage structure. Accordingly, when large numbers of envelopes are to be imprinted in a given run, it is necessary to frequently re-load the exterior envelope storage structure with a new single stack of envelopes to be fed into the machine.

It can be readily seen from the foregoing that it would be desirable to provide image reproduction machinery, such as printers and copiers, with improved apparatus for storing and infeeding envelopes. It is accordingly an object of the present invention to provide such improved apparatus.

SUMMARY OF THE INVENTION

In carrying out principles of the present invention, in accordance with a preferred embodiment thereof, an image reproduction machine, representatively a laser printer, is provided with a dual bin envelope feed tray adapted to support two side-by-side stacks of envelops for longitudinal infeed into the machine through its normal paper supply feed path. According to an important feature of the invention, the loaded envelope feed tray is configured to be removably insertable into the machine housing paper tray opening in place of the paper supply tray normally received therein.

This unique interchangeability between the envelope feed tray and a paper supply tray of the machine advantageously eliminates the conventional necessity of building a separate, external envelope storage and supply structure onto the housing. Additionally, since the envelopes are supported in two side-by-side stacks, a considerably greater quantity of envelopes of the same size may be supplied to the machine in a given batch, or two different envelope sizes (one size in each stack) may be simultaneously made available for machine infeed without envelope size changeout.

The dual bin envelope feed tray of the present invention is provided with a drive structure operable to selectively feed the envelopes of either stack thereof into the machine for delivery (along the same feed path traversed by the paper sheets) to its existing printing means and subsequent discharge into its existing paper receiving means. In a preferred embodiment thereof, the drive structure includes a reversible electric motor operable to selectively rotate a main drive shaft in opposite directions. The shaft has externally toothed, one-way roller bearing clutches secured to opposite ends thereof, the single operative rotational drive direction of one clutch being opposite to that of the other clutch.

The teeth on the spaced apart clutches drivingly mesh with gear trains on opposite sides of the tray, with each gear train being drivable to rotate picker, drive and retard rollers on its side of the tray. With the main drive shaft being rotated in one direction, the picker rollers on one side of the tray operate to frictionally engage and forwardly move the bottom envelope in one stack thereof into its associated drive rollers for feed thereby into the machine's printing section. At the same time, the associated retard roller frictionally engages the upper envelopes in the stack in a manner preventing them from being fed to the drive rollers until they reach the bottom of their stack. Upon reversal of the drive motor, rotation of the first gear train ceases and the opposite gear train is rotationally driven to successively feed envelopes in the other stack, bottom envelope first, to their associated drive rollers.

DETAILED DESCRIPTION

Figure 1:
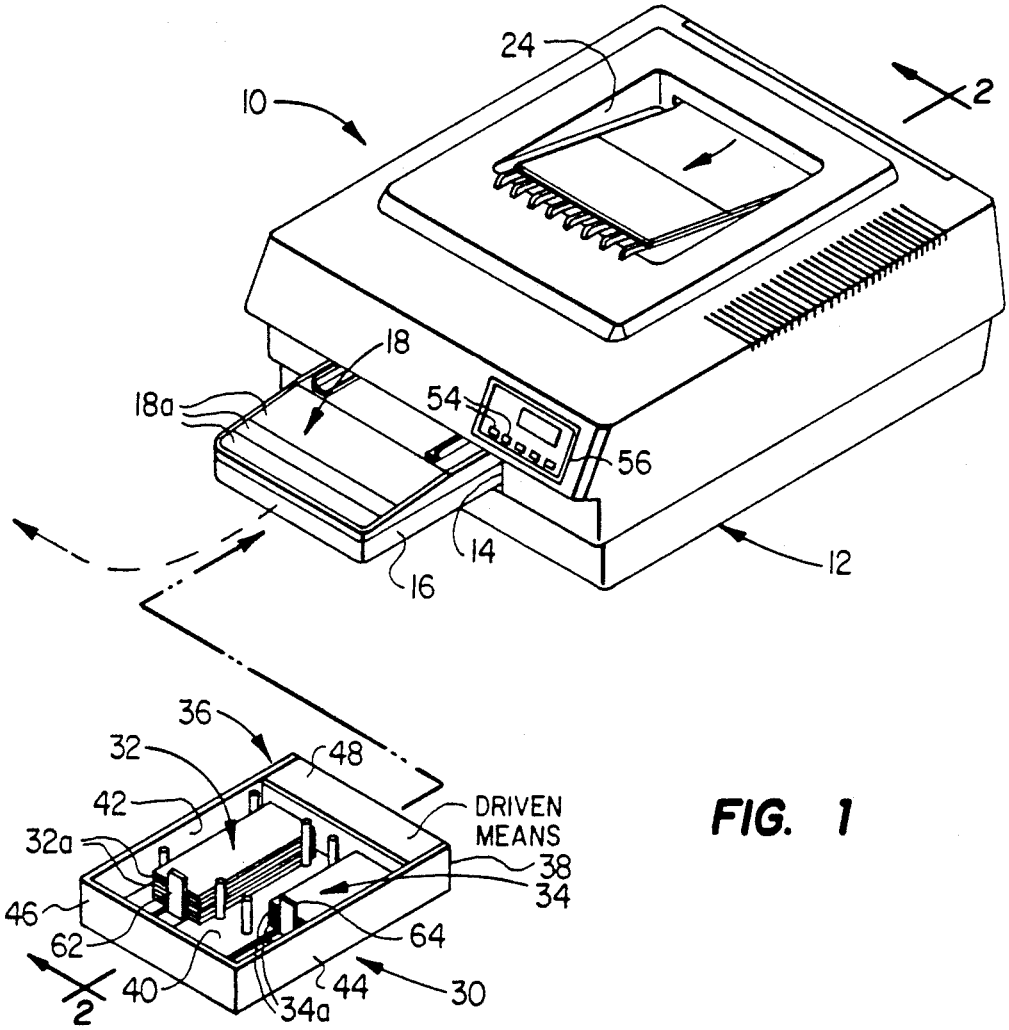
FIG. 1 is a somewhat schematic perspective view of a representative laser printer provided with a unique dual bin envelope feed tray which embodies principles of the present invention and is interchangeable with the printer's conventional paper supply tray.
Figure 2:
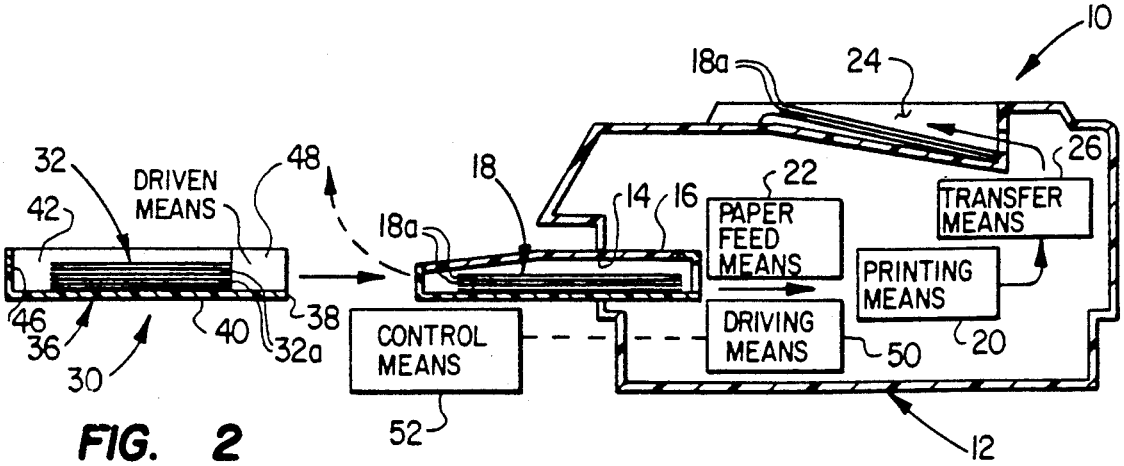
FIG. 2 is a highly schematic cross-sectional view through the printer, taken along line 2—2 of FIG. 1, illustrating drive, printing and transfer means therein, and the general paper path therethrough.

Referring initially to FIGS. 1 and 2, the present invention provides an improved image reproduction machine which is representatively illustrated as being a laser printer 10, although it could alternatively be another type of image reproduction machine such as a copier or non-laser type printer. Laser printer 10 includes a housing 12 having a front opening 14 therein which removably receives a conventional paper supply tray 16 adapted to hold a stack 18 of individual paper sheets $\mathbf{18}_a$.

During operation of the printer 10, with the paper tray 16 operably received in the housing opening 14, the paper sheets $18_a$ are sequentially fed to printing means 20 by paper feed means 22. In a conventional manner, the printing means 20 are operative to imprint paper stock, such as paper sheets $18_a$, fed thereto. The printed sheets $18_a$ exiting the printing means 20 are delivered to and stacked within an external paper receiving well area 24, recessed into the top side of the housing 12, by transfer means 26.

In conventional image reproduction machines, such as printers and copiers, the infeed of envelopes into the machine for imprintation therein (if provided for in the machine) is typically accomplished by building onto the housing 12 a permanent structure (normally on the back end of the housing) dedicated to envelope feeding. If provided, this dedicated envelope feed structure is operative to deliver envelopes to the internal printing means 20 via a feed path separate from the paper sheet feed path, and is designed to support a single stack of envelopes. Because of the multi-layer thickness of each envelope (typically four or five paper layers at its thickest point), the envelope storage capacity of conventional built-in envelope feed structures is quite limited.

As can be seen in FIGS. 1 and 2, the improved printer 10 is not provided with the usual limited capacity built-in envelope feed structure projecting outwardly from the back end of its housing. Instead, according to an important aspect of the present invention, the printer 10 is provided with a unique dual bin envelope tray structure 30 which is configured to be removably insertable into the housing opening 14, in place of the conventional paper supply tray 16, as indicated in FIGS. 1 and 2.

In a manner subsequently described, the envelope tray structure 30 is operative to support, in a side-by-side relationship, two stacks 32 and 34 of differently sized envelopes $32_a$, $34_a$ (for example, legal and personal sized envelopes). If desired, the envelopes in the two side-by-side stacks thereof could be of the same size. The envelope feed tray structure 30 includes a suitably dimensioned tray 36 having an open front end 38, a bottom wall 40, upstanding opposite side walls 42 and 44, and an upstanding rear end wall 46.

Schematically depicted driven means 48 are supported on tray 36 adjacent its open front end 38 and, in a manner subsequently described, cooperate with driving means 50 disposed within housing 12 to sequentially feed envelopes, in an endwise direction from a selectively variable one of the envelope stacks 32 and 34, to the printing means 20 along essentially the same feed path traversed by the paper sheets $18_a$ when the paper tray 16 is inserted into the housing opening 14 in place of the envelope tray 36. The operation of the cooperative driven and driving means 48, 50 is regulated by suitable control means 52 which are also operative to govern the operation of the conventional printing means 20, paper feed means 22, and transfer means 26 disposed within the housing 12. The various printing and feeding tasks of the printer 10 effected and regulated by control means 52 may be selected by using suitable control buttons 54 on a control panel 56 conveniently positioned on the front end of the housing 12.

The dual bin envelope tray structure 30 of the present invention provides the laser printer 10, as well as other types of image reproduction machines into which the tray structure 30 can be incorporated, with a variety of envelope handling advantages compared to the conventional scheme of building a dedicated envelope feed structure onto the exterior of the machine housing remote from the paper sheet feeding apparatus. For example, due to the ability of the tray 36 to support two side-by-side stacks of differently sized envelopes, envelope size may be rapidly changed without the previous necessity of removing a stack of envelopes and replacing it with a stack of differently sized envelopes. Additionally, when the envelopes in the two supported stacks are of the same size, a substantially greater supply quantity of a particular size envelope may be loaded for machine infeed, thereby desirably reducing the frequency with which the envelope tray must be manually reloaded. This correspondingly reduces machine downtime when large numbers of envelopes are to be imprinted in a single run.

Another advantage provided by the dual bin envelope tray structure of the present invention, as previously mentioned, is its desirable ability to utilize essentially the same feed route as that traversed by the paper sheets $18_a$. Compared to image reproduction machines provided with conventional envelope handling apparatus, this simplifies the overall structure of the printer 10, thereby providing the potential for desirably reducing its total fabrication cost.

Figure 3:
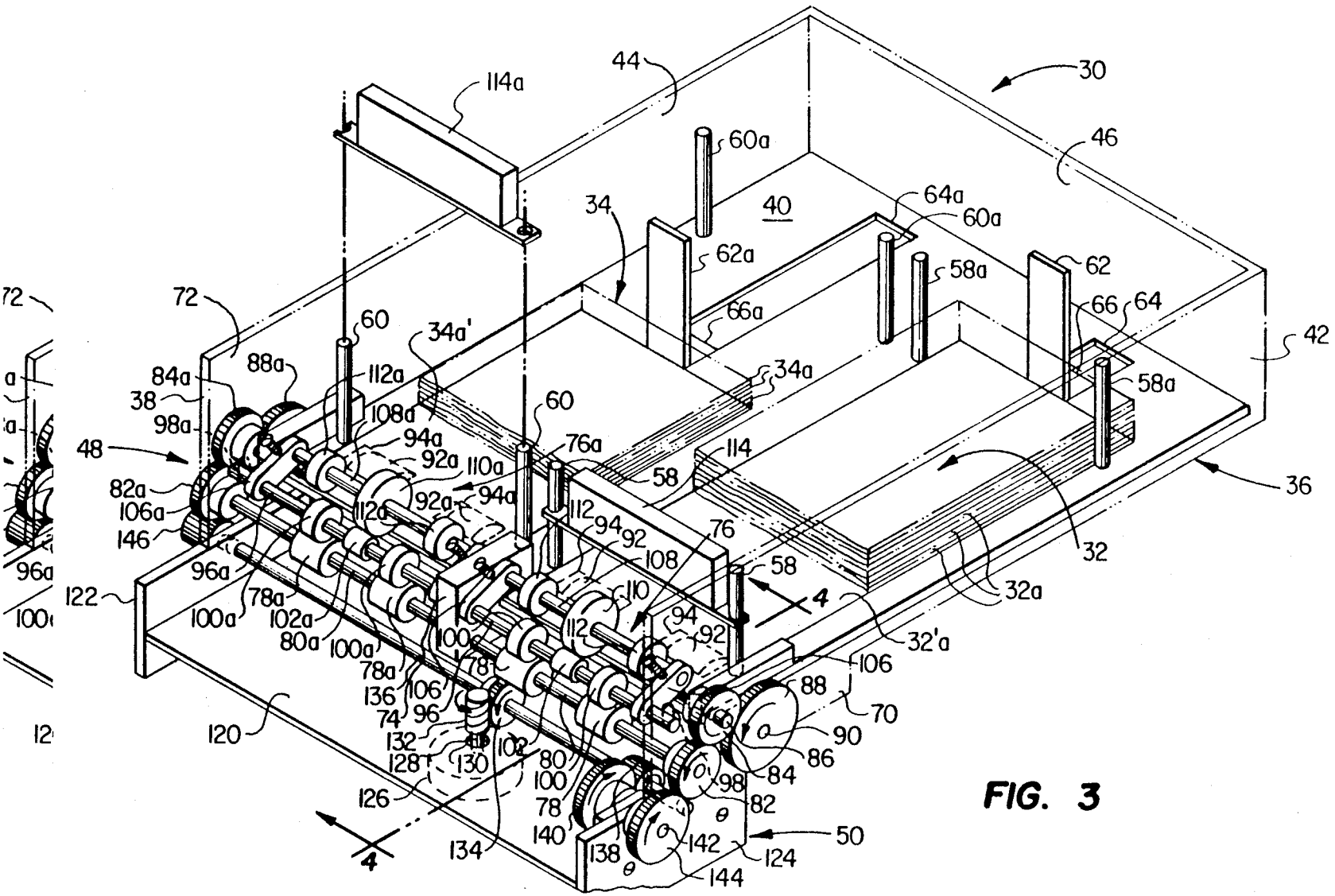
FIG. 3 is an enlarged scale, partially exploded perspective view of the envelope tray, and an associated drive structure, with selected portions thereof being cut away and phantomed for illustrative purposes.

The unique structure and operation of the envelope handling apparatus of the present invention, in its illustrated preferred embodiment, will now be described in conjunction with FIGS. 3 and 4. As best illustrated in FIG. 3, two pairs of vertical support rods 58, 60 project upwardly from the bottom tray wall 40 rearwardly adjacent the open front tray end 38, while two additional pairs of vertical support rods $58_a$, $60_a$ also project upwardly from the bottom tray wall and are spaced rearwardly apart from their associated front support rod pairs 58, 60. The envelope stack 32 is supported on the bottom tray wall 40 between the rod pairs 58, $58_a$ which engage opposite sides of the individual envelopes $32_a$ to hold them in lateral alignment with one another.

The rear or right ends of the envelopes $32_a$ are engaged by an upstanding tab member 62 which projects upwardly through an elongated slot 64 formed through the bottom tray wall 40. Tab member 62 is secured at its lower end to an adjustment member 66 carried on the bottom side of tray wall 40 for sliding movement relative thereto along the length of slot 64. The tab member 62 serves to longitudinally align the individual envelopes $32_a$ initially placed in the "bin" defined by the rod pairs 58, $58_a$.

In a similar fashion, the shorter envelopes $34_a$ in the envelope stack 34 are positioned between the rod pairs 60 and $60_a$ with the front rods 60 engaging the opposite sides of the envelopes $34_a$ and holding them in lateral alignment with one another. When operatively loaded into tray 36 in this manner, the envelope stacks 32, 34 are in a side edge-by-side edge, longitudinally parallel orientation.

An upstanding tab member $62_a$, projecting upwardly through a bottom wall slot $64_a$ and secured to a slidable adjustment member $66_a$, engages the rear or right ends of the envelopes $34_a$ to provide for an initial longitudinal alignment thereof when they are placed in the "bin" defined by the front and rear support rod pairs 60, $60_a$. As illustrated, the stack 32 of envelopes $32_a$ has a bottom envelope $32_a'$ which rests upon the bottom tray wall 40, while the stack 34 of envelopes $34_a$ similarly has a bottom envelope $34_a'$.

For purposes subsequently described, the front end 68 of the bottom tray wall 40 is spaced rearwardly apart from the open front end 38 of the tray 36, front end portions 70 and 72 of tray side walls 42, 44 project downwardly beyond the bottom tray wall 40, and a support block member 74 is secured to a laterally central portion of the front end of bottom tray wall 40 and projects forwardly therefrom. The driven means 48 carried on the tray 36 adjacent its open front end 38 include a pair of envelope feed assemblies 76, $76_a$ which are respectively positioned to the right and left of the support block 74 as viewed in FIG. 3.

In a manner subsequently described, the right and left feed assemblies 76, $76_a$ are independently operable to respectively feed envelopes from the bottom of envelope stack 32 to the aforementioned printing means 20, or to feed envelopes from the bottom of envelope stack 34 to such printing means. The components in the envelope feed assembly $76_a$, and its operation, are identical to the components in and the operation of the envelope feed assembly 76. Accordingly, only the components in and the operation of feed assembly 76 will be described. For ease in comparison, the components in feed assembly $76_a$ have been given reference numerals identical to their counterparts in feed assembly 76, but with the subscripts "a".

The right envelope feed assembly 76 includes a pair of frictional drive rollers 78 coaxially secured to a shaft 80 in a spaced apart relation thereon for rotation therewith. The left or inner end of shaft 80 is journaled in the support block 74, and the right or outer end of shaft 80 extends outwardly through and is rotatably supported within an opening formed through the side wall front end portion 70. An input gear 82 is coaxially anchored to the outer end of shaft 80 and meshes with a transfer gear 84 coaxially anchored to a stub shaft 86 journaled in the side wall front end portion 70. The transfer gear 84, in turn, meshes with a drive gear 88 coaxially anchored to the outer end of a shaft 90 which rotatably extends inwardly through an opening in the side wall front end portion 70 and is journaled at its inner end in the support block 74. Coaxially anchored to the shaft 90, in a longitudinally spaced relationship thereon, are a pair of frictional picker rollers 92, upper side portions of which project upwardly through slots 94 in the bottom tray wall 40.

Positioned above and parallel to the shaft 80 is a pivot shaft 96 which is journaled at its opposite ends in vertically elongated slots 98 formed in the support block 74 and the side wall front end portion 70. An axially spaced apart pair of frictional drive rollers 100 are coaxially secured to shaft 96, overlie the drive rollers 78, and are positioned on opposite sides of a frictional transfer roller 102 which is also coaxially secured to shaft 96. Small coil spring members 104 (FIG. 4) are interconnected between the opposite ends of the shaft 96 and the tray portions 70 and 74, and resiliently bias the opposite ends of shaft 96 toward the bottom ends of their associated vertically elongated slots 98 for a purpose subsequently described herein.

Opposite end portions of the pivot shaft 96 rotatably support the left ends of a pair of elongated connecting members 106, and the right ends of the connecting members 106 rotatably receive the opposite ends of a support shaft 108. A frictional retard roller 110 is coaxially secured to a central portion of the shaft 108 and is frictionally engaged by the transfer roller 102. A pair of cylindrical metal weight members 112 are coaxially mounted on the shaft 108 on opposite sides of the retard roller 110, and a rectangular weight member 114 is slidably carried on the front support rods 58 for vertical movement along their lengths. During loading of the envelope stack 32 into the tray 36 as subsequently described, the shaft 108 may be pivoted in a counterclockwise direction about the shaft 96, and then pivoted in a clockwise direction to its position shown in FIG. 3, after the envelopes are loaded, to operatively position the retard roller 110 as subsequently described.

The drive means 50, disposed within the machine housing 12, include a support structure having a horizontally extending base plate 120 secured at its opposite ends to transverse end plates 122 and 124. A reversible electric motor 126 is suitably secured to the underside of plate 120 and has a rotatable output shaft 128 that extends upwardly through a circular opening 130 formed through the base plate 120. A worm gear 132 is coaxially anchored to an upper end of the shaft 128 and operatively meshes with an externally toothed worm wheel 134 coaxially anchored to a longitudinally intermediate portion of a horizontal drive shaft 136.

The right end of the shaft 136 is journaled in the end plate 124, and just inwardly of the end plate 124 a cylindrical, externally toothed one-way clutch 138 is coaxially secured to the shaft 136. The clutch 138 is a conventional one-way roller bearing clutch which is rotationally drivable by the shaft 136 in a counterclockwise direction, but "idles" (i.e., is not rotationally drivable by shaft 136) when the shaft 136 is rotated in a clockwise direction. The external teeth on the clutch 138 mesh with a transfer gear 140 which is coaxially anchored to the left end of a shaft 142 a central portion of which is journaled in an appropriate opening formed in the end plate 124. The outer or right end of the shaft 142 is coaxially anchored to a drive gear 144.

The left end of the drive shaft 136 is rotatably supported in a suitable opening formed in the left end plate 122, and extends outwardly beyond such end plate. Coaxially secured to the outwardly projecting left end of shaft 136 is a cylindrical, externally toothed one-way clutch 146 which is identical to the previously described clutch 138. However, clutch 146 is rotationally drivable by shaft 136 only in a clockwise direction as viewed in FIG. 3. Accordingly, when the drive shaft 136 is rotated in the illustrated counterclockwise direction, the clutch 146 "idles" on the shaft 136 and is not rotationally driven thereby.

To ready the envelope tray structure 30 for insertion into the housing opening 14 in place of the paper supply tray 16 previously removed therefrom, the envelope stack 32 is loaded into the tray 36 by lifting the rectangular weight member 114 and the envelope stack 32 is placed within the tray 36 between the vertical support rod pairs 58, $58_a$ as previously described with the envelope flap up, and the upstanding tab member 62 is forwardly brought into engagement with the rear ends of the individual envelopes $32_a$. The rectangular weight member 114 is lowered onto the front end of the now loaded envelope stack 32. The envelope stack 34 is then loaded into the opposite side of the tray 36 in a similar manner relative to its support rods 60, its upstanding tab member $62_a$, its rectangular weight member $114_a$ and its associated envelope feed assembly $76_a$.

The loaded envelope tray 36 is then simply inserted, front end first, into the housing opening 14, thereby also longitudinally inserting front end portions of the envelope stacks 32, 34 inwardly through the housing opening 14. Operative insertion of the paper tray 36 into the housing opening 14 automatically causes the input gear 82 to mesh with the drive gear 144, and the input gear $82_a$ to mesh with the external teeth on the one-way clutch 146, as best illustrated in FIG. 3. The envelopes in either of the two side-by-side stacks thereof may then be successively fed to the printing means 20 from the bottom of the selected envelope stack.

To illustrate the envelope infeed, it will be assumed that the envelope stack 32 is initially selected for successive delivery of its envelopes to the printing means 20. To effect this representative envelope delivery, the control means 52 are actuated to cause a counterclockwise rotation of the electric motor output shaft 128, and its attached worm gear 132, as viewed from the top in FIG. 3. The counterclockwise rotation of the worm gear 132 rotates the worm wheel 134 in the indicated counterclockwise direction, thereby rotationally driving the one-way clutch 138 in its operative counterclockwise drive direction.

This selected counterclockwise rotation of the drive shaft 136, however, does not rotationally drive the one-way clutch 146. Accordingly, during the infeed of the envelopes in stack 32 which will now be described, the entire left envelope feed assembly $76_a$ remains idle, and the envelopes in the stack 34 thereof are undisturbed by the operation of the driven and driving means 48, 50.

Figure 4:
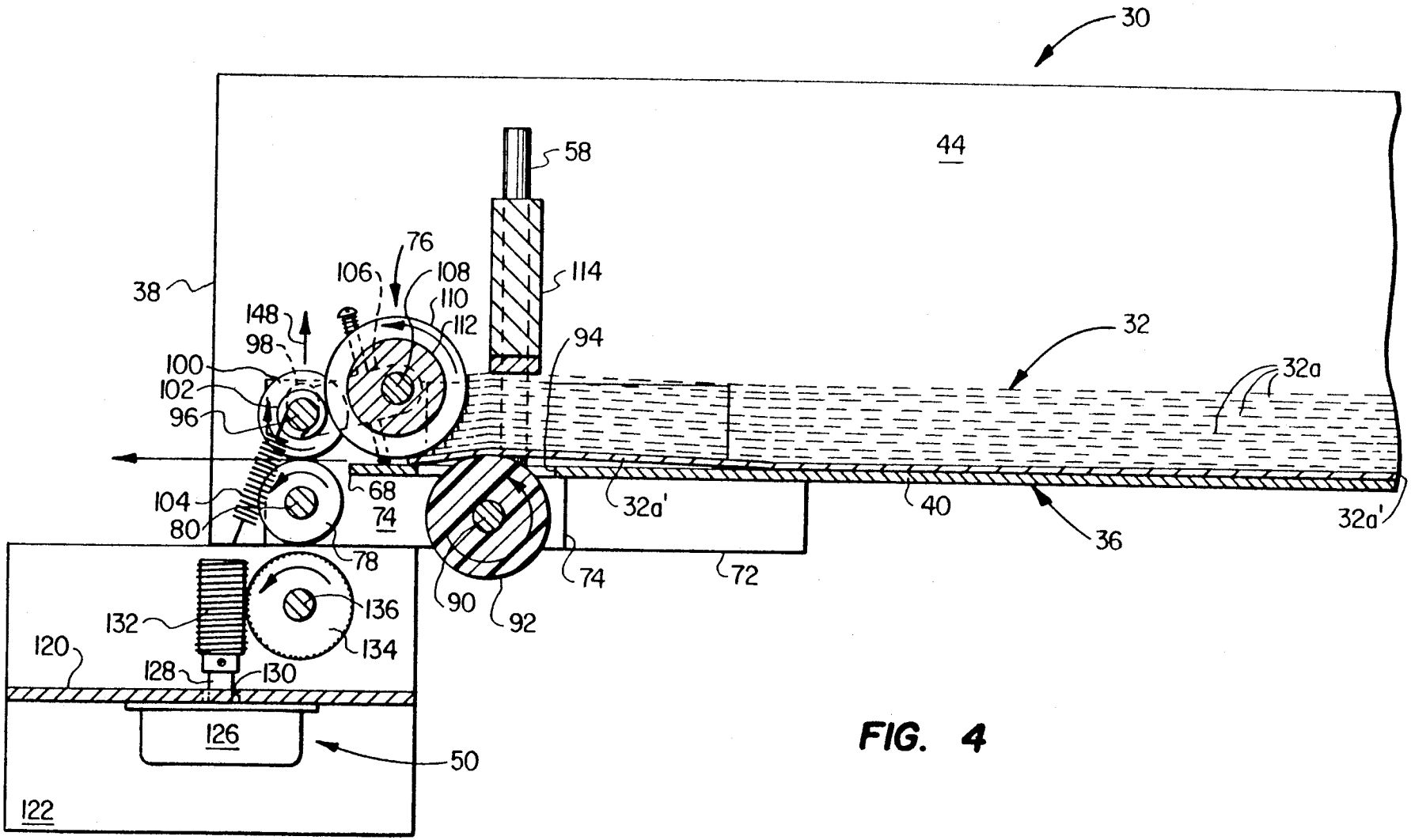
FIG. 4 is an enlarged scale partial cross-sectional view through the envelope tray, and its drive structure, taken along line 4—4 of FIG. 3.

With continued reference to FIGS. 3 and 4, the counterclockwise driven rotation of the one-way clutch 138 causes the lower drive rollers 78 and the picker rollers 92 to be rotationally driven in counterclockwise directions as indicated in FIG. 4. The lower drive rollers 78 frictionally engage the undersides of the upper drive rollers 100 and frictionally drive them, together with the transfer roller 102, in the indicated clockwise direction. Via its frictional engagement with the retard roller 110, the transfer roller 102 drives the retard roller 110 in the indicated counterclockwise direction.

As can be seen in FIG. 4, the rectangular weight member 114 presses front end portions of the envelopes $32_a$ in the envelope stack 32 downwardly against the upper side of the rotating picker rollers 92. Accordingly, the rotating picker rollers 92 frictionally engage a front underside portion of the bottom envelope $32_a'$ and drive it forwardly (i.e., leftwardly) to beneath the underside of the rotating retard roller 110 which exerts a rearwardly directed frictional force on the bottom envelope $32_a'$. However, due to the downward force of the weight member 114, the forwardly directed frictional force of the picker rollers 92 is greater than the rearwardly directed frictional force on the bottom envelope exerted by the retard roller 110. Accordingly, the bottom envelope $32_a'$ is driven forwardly between the rotating upper and lower feed rollers 100, 78 and driven forwardly thereby into the aforementioned printing means 20 for subsequent delivery into the external receiving well 24. The rotating retard roller 110 also exerts a rearwardly directed frictional force on the remaining envelopes $32_a$ to prevent them from being forwardly fed to the printing means along with the bottom envelope $32_a'$. When the bottom envelope $32_a'$ forwardly exits the retard roller 110, the next upwardly adjacent envelope $32_a$ becomes the bottom envelope in the stack 32 and is fed to the printing means as just described in conjunction with the bottom envelope $32_a'$.

As previously mentioned, the shaft 96 is pivotally received as its opposite ends within the vertically elongated slots 98, the opposite ends of the shaft 96 being biased toward the bottom ends of such slots by the spring members 104. This permits the upper drive rollers 100 to be upwardly deflected, as indicated by the arrow 148 in FIG. 4, to automatically adjust the distance between the drive rollers 78, 100 to accommodate thickness variations in the envelopes being fed therethrough to the printing means 20.

To successively feed the envelopes $34_a$ from the envelope stack 34 to the printing means 20, all that is necessary is to reverse the drive direction of the electric motor 126 utilizing the control means 52. Such reversal of the electric motor causes the drive shaft 136 to be driven in a clockwise direction instead of the counterclockwise direction shown in FIGS. 3 and 4. This rotational reversal of the drive shaft 136 rotationally drives the one-way clutch 146 in it clockwise drive direction, thereby operating the left envelope feed assembly $76_a$ to successively feed envelopes $34_a$ to the printing means 20 from the bottom of the envelope stack 34. The clockwise rotation of the drive shaft 136 also renders the one-way clutch 138 inoperative, thereby terminating the driven operation of the right envelope feed assembly 76 and preventing infeed of the envelopes $32_a$ from the envelope stack 32.

As will be readily appreciated by those skilled in this art, the envelope drive structure just described is representative of a variety of drive structures which could be used to feed envelopes to the printing means from a selectively variable one of the two illustrated envelope stacks 32, 34. For example, instead of the illustrated left and right gear trains used to accomplish this selective feeding task, a pulley and belt system, or other equivalent drive structures could be alternatively utilized if desired. Similarly, while the illustrated overall drive structure is conveniently split into the driven means 48 carried by the envelope tray 36, and the driving means 50 disposed within the housing 12, the overall drive structure could be differently separated, or could be essentially entirely incorporated within the machine housing or on the envelope tray structure.

The foregoing detailed description is to be clearly understood as being given by way of illustration and example only, the spirit and scope of the present invention being limited solely by the appended claims.

What is claimed is:

1. A method of feeding envelopes to an image reproduction machine, such as a printer or copier, for imprintation thereby, said image reproduction machine having a housing with an opening therein, a paper supply tray removably insertable into said housing opening and adapted to support a stack of paper sheets, printing means disposed within said housing and operative to imprint paper stock fed thereto, and feed means for feeding paper sheets from the stack thereof supported on the inserted paper supply tray to said printing means, said method comprising the steps of:

removing said paper supply tray from said housing opening;

supporting first and second stacks of envelopes in a side edge-by-side edge, longitudinally parallel orientation;

inserting end portions of the supported first and second envelope stacks inwardly through said housing opening after removal of said paper supply tray therefrom; and longitudinally feeding envelopes, from a selectively variable one of the first and second inserted stacks thereof, to said printing means.

2. The method of claim 1 wherein:

said supporting step is performed by supporting first and second stacks of differently sized envelopes in a side edge-by-side edge, longitudinally parallel orientation.

3. The method of claim 1 wherein:

said supporting step includes the steps of providing an envelope tray structure configured to be selectively and removably insertable into said housing opening in place of said paper supply tray, and operatively loading said first and second stacks of envelopes, in said side edge-by-side edge, longitudinally parallel orientation thereof, into said envelope tray structure, and said inserting step is performed by inserting the operatively loaded envelope tray structure into said housing opening in place of said paper supply tray.

4. For use in conjunction with an image reproduction device, such as a copying machine, printer or the like, having a housing, a paper supply tray removably insertable into an opening in the housing, means for sequentially feeding sheets of paper into said housing from a stack of paper sheets supported on said tray, printing means for printing selected indicia on the sheets fed from the stack, and means for transferring the printed sheets to the exterior of the housing, envelope handling apparatus comprising:

envelope tray means for supporting, in a side-by-side relationship, first and second stacks of envelopes, said envelope tray means being configured to be selectively and removably insertable into said housing opening in place of said paper supply tray; and means, associated with said envelope tray means and operable when said envelope tray means are inserted into said housing opening in place of said paper supply tray, for sequentially feeding envelopes, in an endwise direction from a selectively variable one of the supported first and second envelope stacks, to said printing means.

5. The envelope handling apparatus of claim 4 wherein:

said envelope tray means are operative to selectively support first and second stacks of identically sized envelopes or first and second stacks of differently sized envelopes.

6. The envelope handling apparatus of claim 4 wherein:

said means for sequentially feeding envelopes are operative to sequentially feed envelopes to said printing means from the bottom of the selected envelope stack.

7. The envelope handling apparatus of claim 6 wherein said means for sequentially feeding envelopes include first and second independently operable feed assemblies respectively associated with the first and second envelope stacks, each of said first and second feed assemblies including:

rotationally drivable picker roller means for frictionally engaging a front underside portion of the bottom envelope in their associated envelope stack and forwardly driving the bottom envelope relative to the rest of the envelopes in its stack, weight means for pressing a front end portion of the associated envelope stack downwardly against said picker roller means, rotationally drivable retard roller means for frictionally engaging front end portions of the envelopes in the associated stack in a manner preventing forward feeding of any envelope therein until it reaches the bottom of its stack, and drive roller means rotationally drivable to sequentially feed each successive forwardly driven bottom envelope in the associated stack to said printing means.

8. The envelope handling apparatus of claim 7 further comprising:

drive means for rotationally driving the picker, retard and drive roller means in a selectively variable one of said first and second feed assemblies.

9. The envelope handling apparatus of claim 8 wherein:

each of said first and second feed assemblies includes a gear train, and said drive means include a drive shaft having cylindrical, externally toothed first and second one-way clutch means coaxially secured to opposite end portions thereof and drivingly meshable with said gear trains, said first and second one-way clutch means having opposite rotational drive directions, and means for rotating said drive shaft in selectively opposite directions.

10. The envelope handling apparatus of claim 9 wherein said means for rotating said drive shaft include:

a reversible electric motor having a rotatable output shaft, and worm gear means for drivingly coupling said output shaft to said drive shaft.

11. For use in conjunction with an image reproduction device, such as a copying machine, printer or the like, having a housing, a paper supply tray removably insertable into an opening in the housing, means for sequentially feeding sheets of paper into said housing from a stack of paper sheets supported on said tray, printing means for printing selected indicia on the sheets fed from the stack, and means for transferring the printed sheets to the exterior of said housing, envelope handling apparatus comprising:

envelope tray means for supporting, in a side-by-side relationship, first and second stacks of envelopes, said envelope tray means being configured to be selectively and removably insertable into said housing opening in place of said paper supply tray;

driven means carried by said envelope tray means and operatively drivable, when said envelope tray means are inserted into said housing opening in place of said paper supply tray, to sequentially feed envelopes, in an endwise direction from a selectively variable one of said first and second envelope stacks, to said printing means; and driving means, supportable within said housing, for engaging and operatively driving said driven means when said envelope tray means are inserted into said housing opening in place of said paper supply tray.

12. The envelope handling apparatus of claim 11 wherein:

said envelope tray means are operative to selectively support first and second stacks of identically sized envelopes or first and second stacks of differently sized envelopes.

13. The envelope handling apparatus of claim 11 wherein said driven means comprise first and second independently operable feed assemblies respectively associated with the first and second envelope stacks and positioned adjacent forward ends thereof, each of said first and second feed assemblies including:

rotationally drivable first roller means for frictionally engaging a front underside portion of the bottom envelope in their associated envelope stack and forwardly driving the bottom envelope relative to the rest of the envelopes in its stack, weight means for pressing a front end portion of the associated envelope stack downwardly against said first roller means, rotationally drivable second roller means for frictionally engaging front end portions of the envelopes in the associated stack in a manner preventing forward feeding of any envelope therein until it reaches the bottom of the stack, and rotationally drivable third roller means for sequentially feeding each successive forwardly driven bottom envelope in the associated stack to said printing means.

14. The envelope handling apparatus of claim 13 wherein:

said apparatus further comprises first and second support structures carried by said envelope tray means forwardly adjacent the first and second envelope stacks, respectively, for pivotal movement relative to said envelope tray means toward and away from front end portions of the envelope stacks about axes generally transverse to the lengths of the envelopes, and said second roller means are carried by said first and second support structures for pivotal movement therewith.

15. The envelope handling apparatus of claim 14 wherein each of said support structures includes:

a shaft extending along one of said axes and journaled at its opposite ends to said envelope tray mans, and a generally U-shaped support assembly having outer ends rotatably secured to said shaft, and a central portion to which one of said second roller means is coaxially and rotatably mounted.

16. The envelope handling apparatus of claim 15 wherein:

the opposite ends of each of said shafts are received in slots formed in said envelope tray means and permitting generally vertical movement of the shaft ends relative to said envelope tray means.

17. The envelope handling apparatus of claim 13 wherein:

each of said first and second feed assemblies further includes a gear train drivable to operatively rotate said first, second and third roller means of the feed assembly, and said drive means include a drive shaft having cylindrical, externally toothed first and second one-way clutch means coaxially secured to opposite end portions thereof and drivably meshable with said gear trains, said first and second one-way clutch means having opposite rotational drive directions, and means for rotating said drive shaft in selectively opposite directions.

18. The envelope handling apparatus of claim 17 wherein said means for rotating said drive shaft include:

a reversible electric motor having a rotatable output shaft, and worm gear means for drivingly coupling said output shaft to said drive shaft.

19. An image reproduction machine comprising:

a housing having an opening therein;

a paper supply tray removably insertable into said housing opening and adapted to support a stack of paper sheets;

means for sequentially feeding sheets of paper into said housing from a stack of paper sheets supported on said paper supply tray when said paper supply tray is inserted into said housing opening;

printing means for printing selected indicia on the sheets fed from the stack thereof;

means for transferring the printed sheets to the exterior of said housing;

envelope tray means for supporting, in a side-by-side relationship, first and second stacks of envelopes, said envelope tray means being configured to be selectively and removably insertable into said housing opening in place of said paper supply tray; and means, associated with said envelope tray means and operable, when said envelope tray means are inserted into said housing opening in place of said paper supply tray, to sequentially feed envelopes, in an endwise direction from a selectively variable one of said first and second one of said first and second envelope stacks, to said printing means.

20. The image reproduction machine of claim 19 wherein said image reproduction machine is a printer.

21. The image reproduction machine of claim 19 wherein said image reproduction machine is a laser printer.

22. The image reproduction machine of claim 19 wherein said image reproduction machine is a copier.

23. The image reproduction machine of claim 19 wherein:

said envelope tray means are operative to selectively support first and second side-by-side stacks of identically sized envelopes or first and second side-by-side stacks of differently sized envelopes.

* * * * *